US007644712B2

(12) United States Patent
Schultz

(10) Patent No.: US 7,644,712 B2
(45) Date of Patent: Jan. 12, 2010

(54) NEGATIVE PRESSURE CONDITIONING DEVICE AND FORCED AIR FURNACE EMPLOYING SAME

(75) Inventor: Michael W. Schultz, Elk River, MN (US)

(73) Assignee: Honeywell International Inc., Morristown, NJ (US)

( * ) Notice: Subject to any disclaimer, the term of this patent is extended or adjusted under 35 U.S.C. 154(b) by 429 days.

(21) Appl. No.: 11/164,083

(22) Filed: Nov. 9, 2005

(65) Prior Publication Data

US 2007/0101984 A1 May 10, 2007

(51) Int. Cl.
*F24H 9/20* (2006.01)
*F23N 1/02* (2006.01)

(52) U.S. Cl. ..... 126/116 A; 431/19; 431/12

(58) Field of Classification Search ..... 126/116 A; 431/19

See application file for complete search history.

(56) References Cited

U.S. PATENT DOCUMENTS 4,251,025 A 2/1981 Bonne et al.
4,314,441 A 2/1982 Yannone et al.
4,329,138 A 5/1982 Riordan
4,334,855 A 6/1982 Nelson
4,340,355 A 7/1982 Nelson et al.
4,373,897 A * 2/1983 Torborg ..... 431/20
4,439,139 A 3/1984 Nelson et al.
4,502,625 A 3/1985 Mueller
4,533,315 A 8/1985 Nelson
4,684,060 A 8/1987 Adams et al.
4,688,547 A 8/1987 Ballard et al.
4,703,795 A 11/1987 Beckey
4,708,636 A 11/1987 Johnson
4,729,207 A * 3/1988 Dempsey et al. ..... 126/112
4,767,104 A 8/1988 Plesinger
4,819,587 A 4/1989 Tsutsui et al.
4,892,245 A 1/1990 Dunaway et al.
4,915,615 A 4/1990 Kawamura et al.
5,026,270 A 6/1991 Adams et al.
5,248,083 A 9/1993 Adams et al.
5,307,990 A 5/1994 Adams et al.
5,331,944 A 7/1994 Kujawa et al.
5,340,028 A 8/1994 Thompson
5,347,981 A 9/1994 Southern et al.
5,408,986 A * 4/1995 Bigham ..... 126/110 R
5,520,533 A 5/1996 Vrolijk
5,590,642 A 1/1997 Borgeson et al.
5,630,408 A 5/1997 Versluis
5,720,231 A 2/1998 Rowlette et al.

(Continued)

OTHER PUBLICATIONS

Honeywell, "45.801.175, Amplification Gas/Air Module for VK4105R/VK8105R Gas Controls," Production Handbook, 8 pages, prior to Oct. 18, 2006.

(Continued)

*Primary Examiner*—Kenneth B Rinehart
*Assistant Examiner*—Chuka C Ndubizu

(57) ABSTRACT

A pneumatic signal conditioning device may have a first fluid path and a second fluid path. The first fluid path includes a first inlet and a first outlet, and is configured such that the first outlet provides a first conditioned signal representing a pressure at the first inlet. Similarly, the second fluid path is configured such that the second outlet provides a second conditioned signal representing a pressure at the second inlet.

17 Claims, 6 Drawing Sheets

U.S. PATENT DOCUMENTS

| | | | | |
|---|---|---|---|---|
| 5,732,691 | A | 3/1998 | Maiello et al. | |
| 5,791,332 | A | 8/1998 | Thompson et al. | |
| 5,806,440 | A | 9/1998 | Rowlette et al. | |
| 5,819,721 | A | 10/1998 | Carr et al. | |
| 5,860,411 | A | 1/1999 | Thompson et al. | |
| 5,865,611 | A | 2/1999 | Maiello | |
| 5,993,195 | A * | 11/1999 | Thompson | 431/19 |
| 6,000,622 | A | 12/1999 | Tonner et al. | |
| 6,109,255 | A | 8/2000 | Dieckmann et al. | |
| 6,254,008 | B1 | 7/2001 | Erickson et al. | |
| 6,257,870 | B1 | 7/2001 | Hugghins et al. | |
| 6,283,115 | B1 * | 9/2001 | Dempsey et al. | 126/110 R |
| 6,321,744 | B1 * | 11/2001 | Dempsey et al. | 126/116 A |
| 6,354,327 | B1 * | 3/2002 | Mayhew | 137/596 |
| 6,377,426 | B2 | 4/2002 | Hugghins et al. | |
| 6,571,817 | B1 | 6/2003 | Bohan, Jr. | |
| 6,705,533 | B2 | 3/2004 | Casey et al. | |
| 6,749,423 | B2 | 6/2004 | Fredricks et al. | |
| 6,758,909 | B2 | 7/2004 | Jonnalagadda et al. | |
| 6,764,298 | B2 | 7/2004 | Kim et al. | |
| 6,793,015 | B1 | 9/2004 | Brown et al. | |
| 6,846,514 | B2 | 1/2005 | Jonnalagadda et al. | |
| 6,880,548 | B2 | 4/2005 | Schultz et al. | |
| 6,918,756 | B2 | 7/2005 | Fredricks et al. | |
| 6,923,643 | B2 | 8/2005 | Schultz et al. | |
| 6,925,999 | B2 | 8/2005 | Hugghins et al. | |
| 7,055,759 | B2 | 6/2006 | Wacker et al. | |
| 7,101,172 | B2 * | 9/2006 | Jaeschke | 431/19 |
| 7,111,503 | B2 * | 9/2006 | Brumboiu et al. | 73/64.56 |
| 2002/0155405 | A1 | 10/2002 | Casey et al. | |
| 2003/0011342 | A1 | 1/2003 | Eichorn | |
| 2005/0155404 | A1 | 7/2005 | Geho et al. | |
| 2005/0159844 | A1 | 7/2005 | Sigafus et al. | |
| 2006/0105279 | A1 | 5/2006 | Munsterhuis et al. | |

OTHER PUBLICATIONS

Honeywell, "VK41..R/VK81..R Series, Gas Controls with Integrated Gas/Air Module for Combined Valve and Ignition System," Instruction Sheet, 6 pages, prior to Oct. 18, 2006.

http://www.regal-beloit.com/gedraft.html, "Welcome to GE Commercial Motors by Regal-Beloit," 1 page, printed Apr. 26, 2006.

Lennox, "G61MPV Series Units," Installation Instructions, 2 pages, Oct. 2006.

* cited by examiner

NEGATIVE PRESSURE CONDITIONING DEVICE AND FORCED AIR FURNACE EMPLOYING SAME

TECHNICAL FIELD

The present invention pertains generally to HVAC systems and more particularly to furnaces such as forced-air furnaces relying upon a pneumatic signal to control a gas valve.

BACKGROUND

Many homes rely upon forced-air furnaces to provide heat during cool and/or cold weather. Typically, a forced-air furnace employs a burner that burns a fuel such as natural gas, propane or the like, and provides heated combustion gases to the interior of a heat exchanger. A circulating blower forces return air from the house over or through the heat exchanger, thereby heating the air. The combustion gases proceed through the heat exchanger to a collector box, and are then exhausted. In some cases, a combustion gas blower pulls the combustion gases through the heat exchanger and the collector box. The heated air is subsequently routed throughout the house via a duct system. A return duct system returns air to the furnace to be re-heated.

A gas valve controls how much fuel is provided to the burner. In some instances, a pressure drop across the heat exchanger, i.e., between the burner and the collector box, may be used as a signal to the gas valve to regulate gas flow to the burner, as this pressure drop is known to be at least roughly proportional to the combustion gas flow through the heat exchanger. However, this pressure signal is subject to transient spikes resulting from the combustion gas blower cycling on and off, system harmonics, and the like. Thus, a need remains for improved devices and methods of controlling furnaces such as forced-air furnaces.

SUMMARY

The present invention pertains to improved devices and method of controlling furnaces such as forced-air furnaces. In some instances, a conditioned pneumatic signal may be used as an input signal to a gas valve in aiding operation of the furnace.

Accordingly, an example embodiment of the present invention may be found in a pneumatic signal conditioning device that has a first fluid path and a second fluid path. The first fluid path includes a first inlet and a first outlet, and is configured such that the first outlet provides a first conditioned signal representing a pressure at the first inlet. Similarly, the second fluid path is configured such that the second outlet provides a second conditioned signal representing a pressure at the second inlet.

In some instances, the first fluid path may include an internal flow restriction. At least one of the first inlet and the first outlet may include a conditioning orifice. In some cases, the first inlet may include a first inlet conditioning orifice and the first outlet may include a first outlet conditioning orifice. In some cases, the second fluid path may include an internal flow restriction. At least one of the second inlet and the second outlet may include a conditioning orifice. In some cases, the second inlet may include a second inlet conditioning orifice and the second outlet may include a second outlet conditioning orifice.

The pneumatic signal conditioning device may also include a third fluid path that is disposed between the first fluid path and the second fluid path, thereby providing fluid communication between the first fluid path and the second fluid path. A bleed orifice may be disposed within the third fluid path.

In some instances, a fourth fluid path may be disposed between the first fluid path and the second fluid path, thereby providing fluid communication between the first fluid path and the second fluid path. A fixed bleed orifice disposed may be disposed within the third fluid path and an adjustable bleed orifice may be disposed within the fourth fluid path.

In some instances, the pneumatic signal conditioning device may include a reference vent that is in fluid communication with at least one of the first fluid path and the second fluid path. The reference vent may, in some circumstances, also be in fluid communication with the atmosphere exterior to the pneumatic signal conditioning device.

Another example embodiment of the present invention may be found in a forced-air furnace that includes a heat exchanger having an upstream port and a downstream port, a burner that is configured to provide combustion products to the heat exchanger, and a gas valve that is configured to provide fuel to the burner. The gas valve may include a first pressure port and a second pressure port.

The forced-air furnace also includes the pneumatic signal conditioning device described above. The first inlet of the pneumatic signal conditioning device may be in fluid communication with the upstream port of the heat exchanger, the second inlet of the pneumatic signal conditioning device may be in fluid communication with the downstream port of the heat exchanger, the first outlet of the pneumatic signal conditioning device may be in fluid communication with the first pressure port of the gas valve and the second outlet of the pneumatic signal conditioning device may be in fluid communication with the second pressure port of the gas valve. In some instances, the upstream port may be located proximate the burner. The furnace may also include a collector box that is positioned proximate the downstream port of the heat exchanger.

Another example embodiment of the present invention may be found in a furnace that includes a burner manifold, a collector box and a heat exchanger. The heat exchanger may include an inlet that is in fluid communication with the burner manifold and an outlet that may be in fluid communication with the collector box. The furnace also includes a gas valve that is configured to provide fuel to the burner manifold in response to a signal that represents a pressure drop between the burner and the collector box.

The furnace may include structure or apparatus that is configured to condition the signal. For example, the structure or apparatus that is configured to condition the signal may be adapted to dampen transient pressure spikes. In some instances, the furnace further includes a blower that is adapted to blow air across the exterior of the heat exchanger.

Another example embodiment of the present invention may be found in a negative pressure conditioning device that is designed for use with a forced air furnace that includes a gas valve, a burner manifold and a collector box. The negative pressure conditioning device may include a first gas valve port and a second gas valve port that are adapted to be in fluid communication with the gas valve. A first conditioning orifice is disposed within the first gas valve port. A second conditioning orifice is disposed within the second gas valve port.

The negative conditioning device may include a burner manifold port that is adapted to be in fluid communication with the burner manifold as well as a collector box port that is adapted to be in fluid communication with the collector box. A burner manifold conditioning orifice may be disposed within the burner manifold port. A collector box conditioning orifice may be disposed within the collector box port.

Another example embodiment of the present invention may be found in a method of controlling a forced-air furnace that includes a burner, a collector box and a gas valve that controls gas flow to the burner. A first pressure at the burner may be monitored. A second pressure at the collector box may be monitored. A conditioned signal may be provided that represents a difference between the first pressure and the second pressure. The operation of the gas valve may be affected by the conditioned signal. In some instances, the conditioned signal may be a pneumatic signal in which transient spikes are damped.

The above summary of the present invention is not intended to describe each disclosed embodiment or every implementation of the present invention. The Figures, Detailed Description and Examples which follow more particularly exemplify these embodiments.

DETAILED DESCRIPTION OF THE FIGURES

The invention may be more completely understood in consideration of the following detailed description of various embodiments of the invention in connection with the accompanying drawings, in which.

Figure 1:
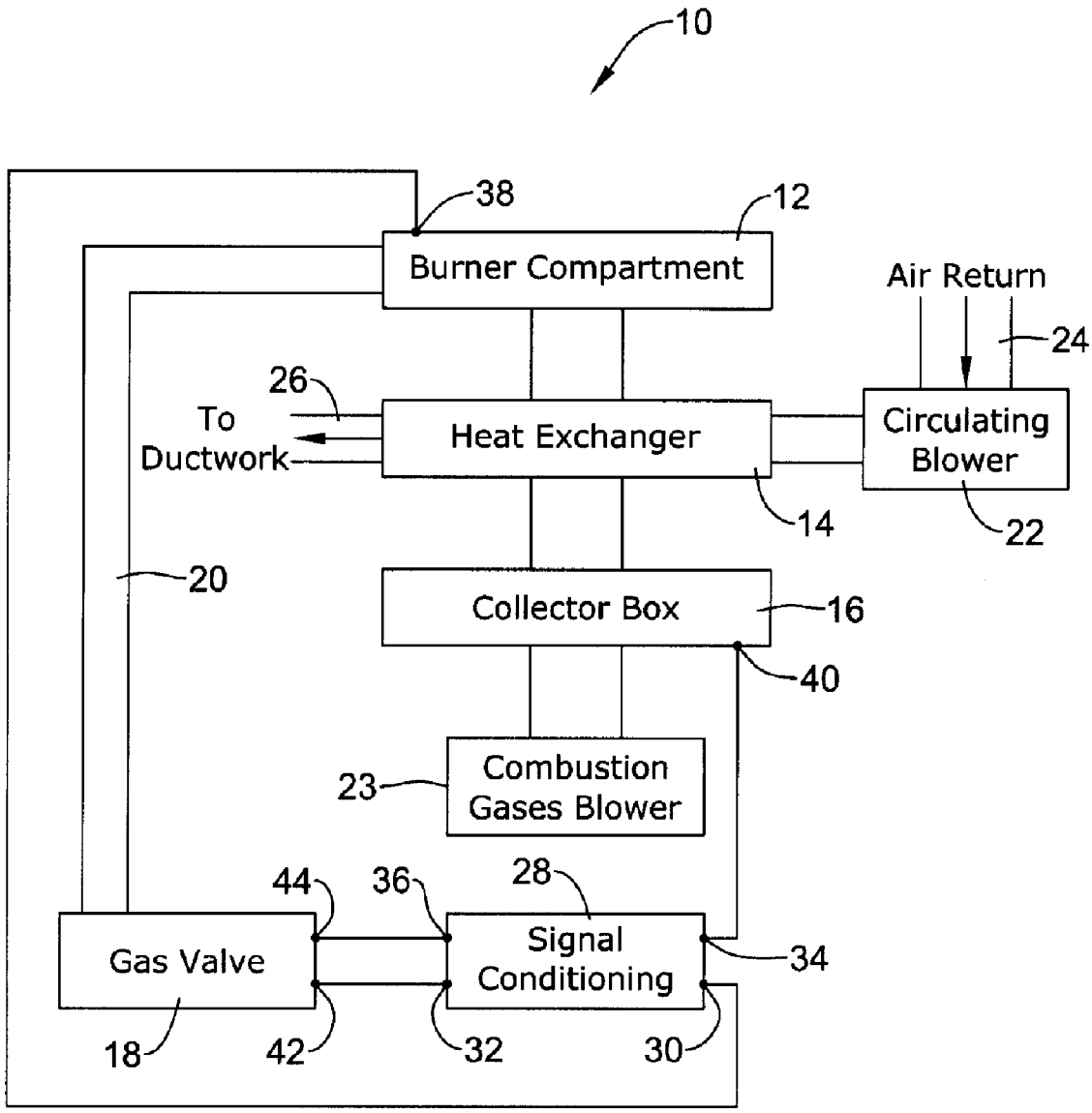
FIG. 1 is a diagrammatic illustration of a forced-air furnace in accordance with an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

FIG. 1 is a highly diagrammatic illustration of a forced-air furnace 10, which may include additional components not described herein. The primary components of furnace 10 include a burner compartment 12, a heat exchanger 14 and a collector box 16. A gas valve 18 provides fuel such as natural gas or propane, from a source (not illustrated) to burner compartment 12 via a gas line 20. Burner compartment 12 burns the fuel provided by gas valve 18, and provides heated combustion products to heat exchanger 14. The heated combustion products pass through heat exchanger 14 and exit into collector box 16, which ultimately exhausts (not illustrated) to the exterior of the building or home in which furnace 10 is installed.

A circulating blower 22 accepts return air from the building or home's return ductwork 24 and blows the return air through heat exchanger 14, thereby heating the air. The heated air then exits heat exchanger 14 and enters the building or home's conditioned air ductwork 26. For enhanced thermal transfer and efficiency, the heated combustion products may pass through heat exchanger 14 in a first direction while circulating blower 22 forces air through heat exchanger 14 in a second, opposite direction. In some cases, as illustrated, a combustion gas blower 23 may be positioned downstream of collector box 16 and may pull combustion gases through heat exchanger 14 and collector box 16.

In some instances, for example, the heated combustion products may pass downwardly through heat exchanger 14 while the air blown through by circulating blower 22 may pass upwardly through heat exchanger 14, but this is not required.

As noted, gas valve 18 provides fuel, via fuel line 20, to burner compartment 12. Gas valve 18 may, in some instances, rely at least partially on a measurement of the pressure drop through heat exchanger 14 in order to regulate gas flow to burner compartment 12. In order to provide an improved, conditioned, signal to gas valve 18, furnace 10 may include a signal conditioning device 28. The internal structure of an illustrative signal conditioning device 28 is more fully described in subsequent Figures.

The illustrative signal conditioning device 28 includes a first inlet 30 and a first outlet 32, and a second inlet 34 and a second outlet 36. First inlet 30 is in fluid communication with a burner compartment pressure port 38 while second inlet 34 is in fluid communication with a collector box pressure port 40. First outlet 32 is in fluid communication with a first pressure port 42 present on gas valve 18 while second outlet 36 is in fluid communication with a second pressure port 44 present on gas valve 18.

It can be seen that a pneumatic signal at first inlet 30 represents a pressure at burner compartment 12, i.e, at the top or inlet of heat exchanger 14 while a pneumatic signal at second inlet 34 represents a pressure at collector box 16, i.e, at the bottom or outlet of heat exchanger 14. Thus, the difference therebetween provides an indication of the pressure drop across heat exchanger 14.

However, as noted previously, this pressure signal may be subject to various transient interruptions. Consequently, signal conditioning device 28 is configured to provide a conditioned (e.g. damped) pneumatic signal from first outlet 32 and/or second outlet 36. As a result, gas valve 18 may be provided with a stable pneumatic signal across first pressure port 42 and second pressure port 44. Signal conditioning device 28 may take several different forms, as outlined in subsequent Figures. Signal conditioning device 28 may be formed of any suitable polymeric, metallic or other material, as desired. In some instances, signal conditioning device 28 may be molded as an integral unit. In other cases, signal conditioning device 28 may be formed by joining tubular sections together using any suitable technique such as adhesives, thermal welding, sonic welding and the like.

Figure 2:
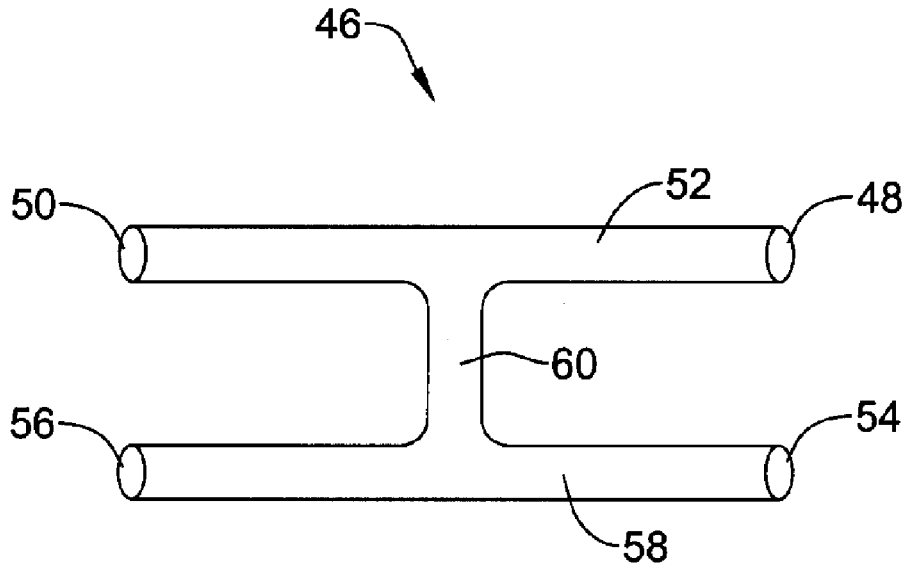
FIG. 2 is a view of a pneumatic signal conditioning device in accordance with an embodiment of the invention.
Figure 3:
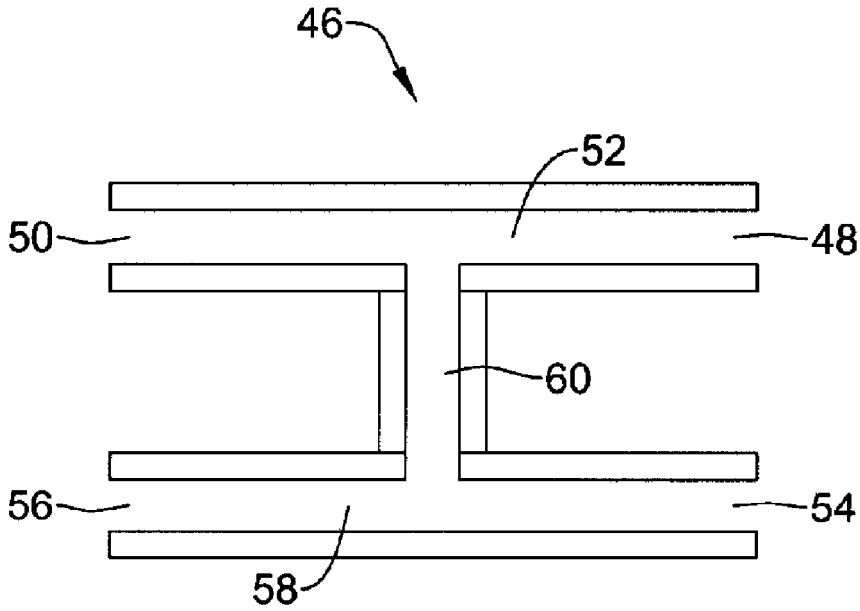
FIG. 3 is a cross-section of FIG. 2.

FIGS. 2 and 3 show an illustrative signal conditioning device 46 in accordance with the present invention. FIG. 2 is an exterior view while FIG. 3 is a cross-section, better illustrating the fluid paths extending through signal conditioning device 46. Signal conditioning device 46 has a first inlet 48, a first outlet 50 and a first fluid path 52 extending from first inlet 48 to first outlet 50. Similarly, signal conditioning device 46 includes a second inlet 54, a second outlet 56, and a second fluid path 58 that extends from second inlet 54 to second outlet 56. In the illustrative embodiment, a third fluid path 60 extends from first fluid path 52 to second fluid path 58.

In the illustrative embodiment, first fluid path 52, second fluid path 58 and third fluid path 60 of signal conditioning device 46 are diagrammatically shown as being approximately the same size. It should be recognized that while each of first fluid path 52, second fluid path 58 and third fluid path 60 may have similar or even identical dimensions, this is not required.

In a particular embodiment, for example, signal conditioning device 46 may have an overall length of about 1.375 inches, an overall width of about 1.63 inches and an overall thickness of about 0.46 inches. First inlet 48 and second inlet 54 may each have an internal diameter of about 0.26 inches. First outlet 50 and second outlet 56 may each have an internal diameter of about 0.325 inches. These inlet and outlet dimensions may be altered by inclusion of appropriately sized conditioning orifices, as will be more fully discussed with respect to subsequent Figures. It will be recognized that these dimensions may also be varied to accommodate various combinations of particular gas valves and particular furnaces.

Figure 4:
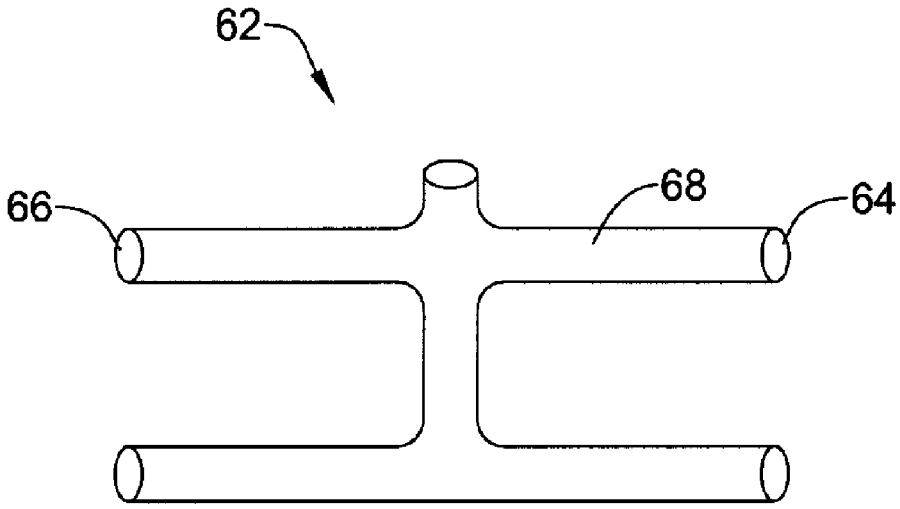
FIG. 4 is a view of a pneumatic signal conditioning device in accordance with an embodiment of the invention.
Figure 5:
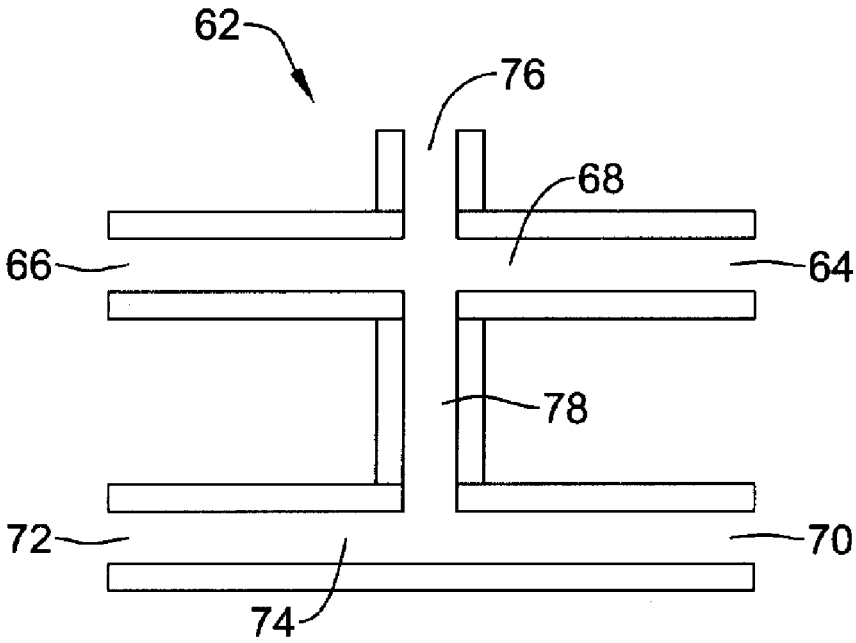
FIG. 5 is a cross-section of FIG. 4.

FIGS. 4 and 5 show another illustrative signal conditioning device 62 in accordance with the present invention. FIG. 4 is an exterior view while FIG. 5 is a cross-section, better illustrating the fluid paths extending through signal conditioning device 62. Signal conditioning device 62 has a first inlet 64, a first outlet 66 and a first fluid path 68 extending from first inlet 64 to first outlet 66. Similarly, signal conditioning device 62 includes a second inlet 70, a second outlet 72 and a second fluid path 74 that extends from second inlet 70 to second outlet 72. Signal conditioning device 62 also includes a reference port 76 that is in fluid communication with at least first fluid path 68. A third fluid path 78 extends from first fluid path 68 to second fluid path 74, and provides fluid communication therebetween.

Figure 6:
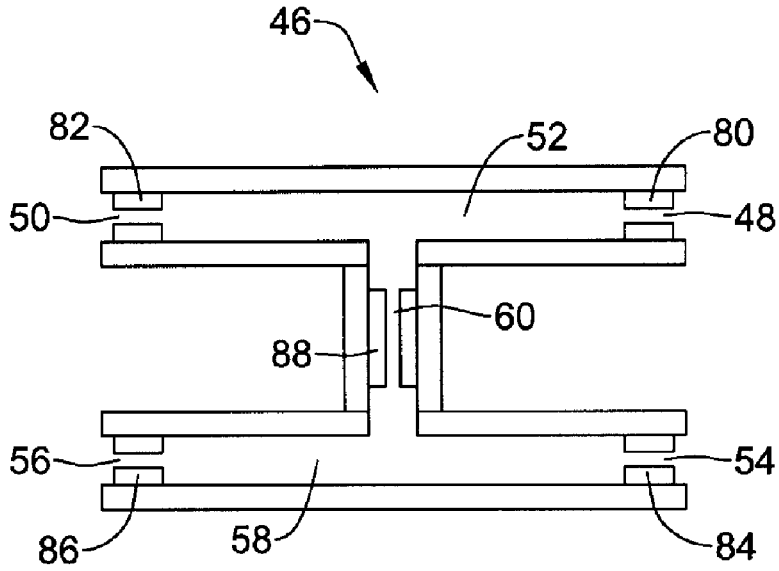
FIG. 6 is a cross-sectional view of the pneumatic signal conditioning device of FIG. 2, including conditioning orifices.

FIG. 6 is a cross-section akin to the embodiment shown in FIGS. 2 and 3, but includes conditioning orifices. FIG. 6 shows signal conditioning device 46 as it might be tuned for a particular application. By varying the internal dimensions of each of the conditioning orifices, it has been determined that a conditioned signal, in which transients have been damped, may be provided.

It can be seen that first inlet 48 includes a first inlet conditioning orifice 80 while first outlet 50 includes a first outlet conditioning orifice 82. Similarly, second inlet 54 includes a second inlet conditioning orifice 84 and second outlet 56 includes a second outlet conditioning orifice 86. Third fluid path 60 includes a bleed orifice 88. In some instances, first inlet conditioning orifice 80 and second inlet conditioning orifice 84 may be referred to, respectively, as a burner manifold conditioning orifice and as a collector box conditioning orifice.

In some instances, pneumatic signal conditioning device 46 may be constructed in a way to facilitate placement of bleed orifice 88 within third fluid path 60. In some cases, the tubing or other structure forming first fluid path 52 may, for example, include a removable plug or other structure that provides access to third fluid path 60 yet can be inserted to retain the fluid properties of first fluid path 52.

In some cases, pneumatic signal conditioning device 46 may be constructed by combining a first tee, a second tee and a short length of tubing. For example, a first tee may form first fluid path 52 while a second tee may form second fluid path 58. Third fluid path 60 may be formed by extending a short length of tubing between the first and second tees. It will be recognized that such a structure would provide ready access to an interior of third fluid path 60 for placing and/or replacing bleed orifice 88.

Figure 7:
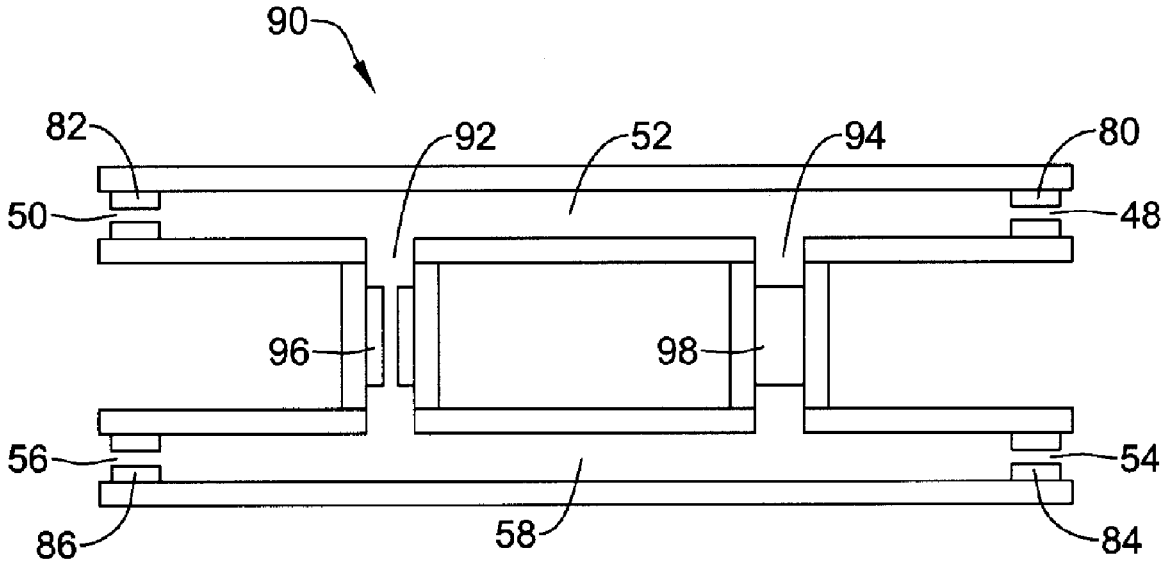
FIG. 7 is a cross-sectional view of a pneumatic signal conditioning device in accordance with an embodiment of the invention.

FIG. 7 is a cross-section view of a pneumatic signal conditioning device 90 including several conditioning orifices. By varying the internal dimensions of each of the conditioning orifices, it has been determined that a conditioned signal, in which transients have been damped, may be provided.

It can be seen that first inlet 48 includes a first inlet conditioning orifice 80 while first outlet 50 includes a first outlet conditioning orifice 82. Similarly, second inlet 54 includes a second inlet conditioning orifice 84 and second outlet 56 includes a second outlet conditioning orifice 86. Unlike FIG. 6, however, pneumatic signal conditioning device 90 includes both a third fluid path 92 and a fourth fluid path 94. In some cases, fourth fluid path 94 may be at least substantially parallel to third fluid path 92, but this is not required.

Third fluid path 92 may include a fixed bleed orifice 96 and fourth fluid path 94 may include an adjustable orifice 98. Adjustable orifice 98 may be any structure that provides an opportunity for adjusting airflow permitted through adjustable orifice 98. In some cases, for example, adjustable orifice 98 may be adjustable via a set screw or other similar structure. In some cases, fixed bleed orifice 96 may provide a fixed minimum bleed while adjustable orifice 98 may be adjusted in order to modify or fine tune the relative amount of bleeding that occurs through pneumatic signal conditioning device 90.

In some instances, first inlet conditioning orifice 80 and second inlet conditioning orifice 84 may be referred to, respectively, as a burner manifold conditioning orifice and as a collector box conditioning orifice. As discussed with respect to FIG. 6, pneumatic signal conditioning device 90 may be constructed in a way to facilitate placement of fixed bleed orifice 96 and adjustable orifice 98.

Figure 8:
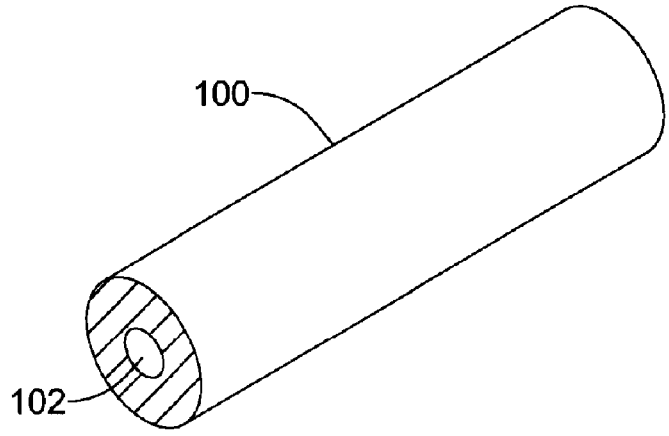
FIG. 8 is a perspective view of a conditioning orifice in accordance with an embodiment of the invention.
Figure 9:
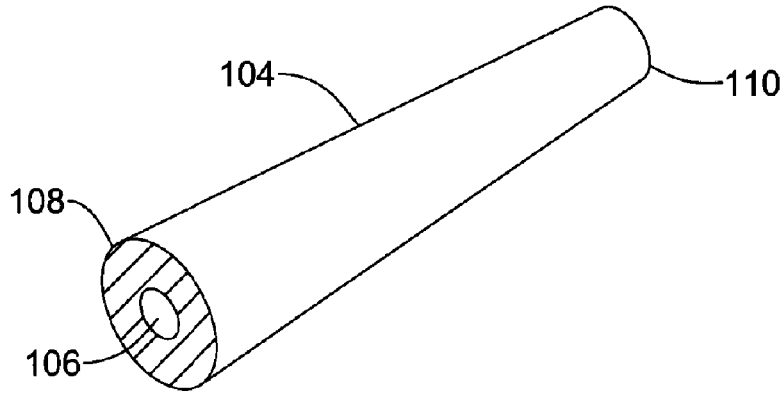
FIG. 9 is a perspective view of a conditioning orifice in accordance with an embodiment of the invention.
Figure 10:
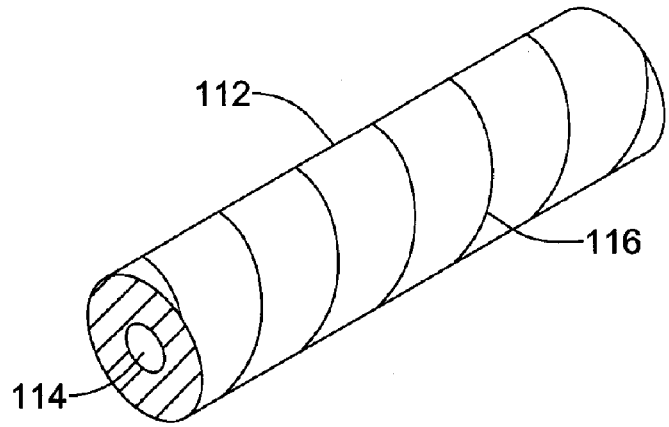
FIG. 10 is a perspective view of a conditioning orifice in accordance with an embodiment of the invention.

FIGS. 8, 9 and 10 show illustrative embodiments for these conditioning orifices. FIG. 8 shows a cylindrical conditioning orifice 100 including an aperture 102 extending therethrough. In some instances, signal conditioning device 46 (and the others described herein) may be tuned by varying the relative size of aperture 102 in one or more of the conditioning apertures used. Aperture 102 may vary in size along the length of the cylindrical conditioning orifice 100, or aperture 102 may have a constant diameter. In a particular instance, aperture 102 may have a constant diameter of about 0.146 inches, although this dimension may changed to accommodate various combinations of particular gas valves and particular furnaces.

Cylindrical conditioning orifice 100 may be secured within the appropriate inlet or outlet using any suitable technique, such as a compression fit, adhesives, solder, or the like. Alternatively, cylindrical conditioning orifice 100 may be integrally molded within the appropriate inlet or outlet.

FIG. 9 shows a tapered conditioning orifice 104 having an aperture 106 extending from an outer end 108 to an inner end 110. In some instances, signal conditioning device 46 may be tuned by varying the relative size of aperture 106 in one or more of the conditioning apertures used. Aperture 106 may vary in diameter along the length of the tapered conditioning orifice 104, or aperture 106 may have a constant diameter. In a particular instance, aperture 106 may have a constant diameter of about 0.146 inches, although this dimension may changed to accommodate various combinations of particular gas valves and particular furnaces.

Tapered conditioning orifice 104 may be secured within the appropriate inlet or outlet using any suitable technique, such as a compression fit, adhesives, solder, or the like. Alternatively, tapered conditioning orifice 104 may be integrally molded within the appropriate inlet or outlet.

FIG. 10 shows a cylindrical conditioning aperture 112 having an aperture 114 extending therethrough. In some instances, signal conditioning device 46 may be tuned by varying the relative size of aperture 114 in one or more of the conditioning apertures used. Aperture 114 may vary in diameter along the length of the cylindrical conditioning orifice 112, or aperture 114 may have a constant diameter. In a particular instance, aperture 114 may have a diameter of about 0.146 inches, although this dimension may changed to accommodate various combinations of particular gas valves and particular furnaces.

Cylindrical conditioning orifice 112 includes threads 116 on an exterior surface thereof, and thus may be screwed into the appropriate inlet or outlet, if desired.

In the embodiments discussed above, it has been considered that the apertures extending the length of the conditioning orifices have constant or perhaps tapering diameters. It is contemplated, however, that these apertures may well have a more complicated geometry. For example, an aperture through a conditioning orifice may have a diameter that changes one or more times, in a step-wise manner.

Figure 11:
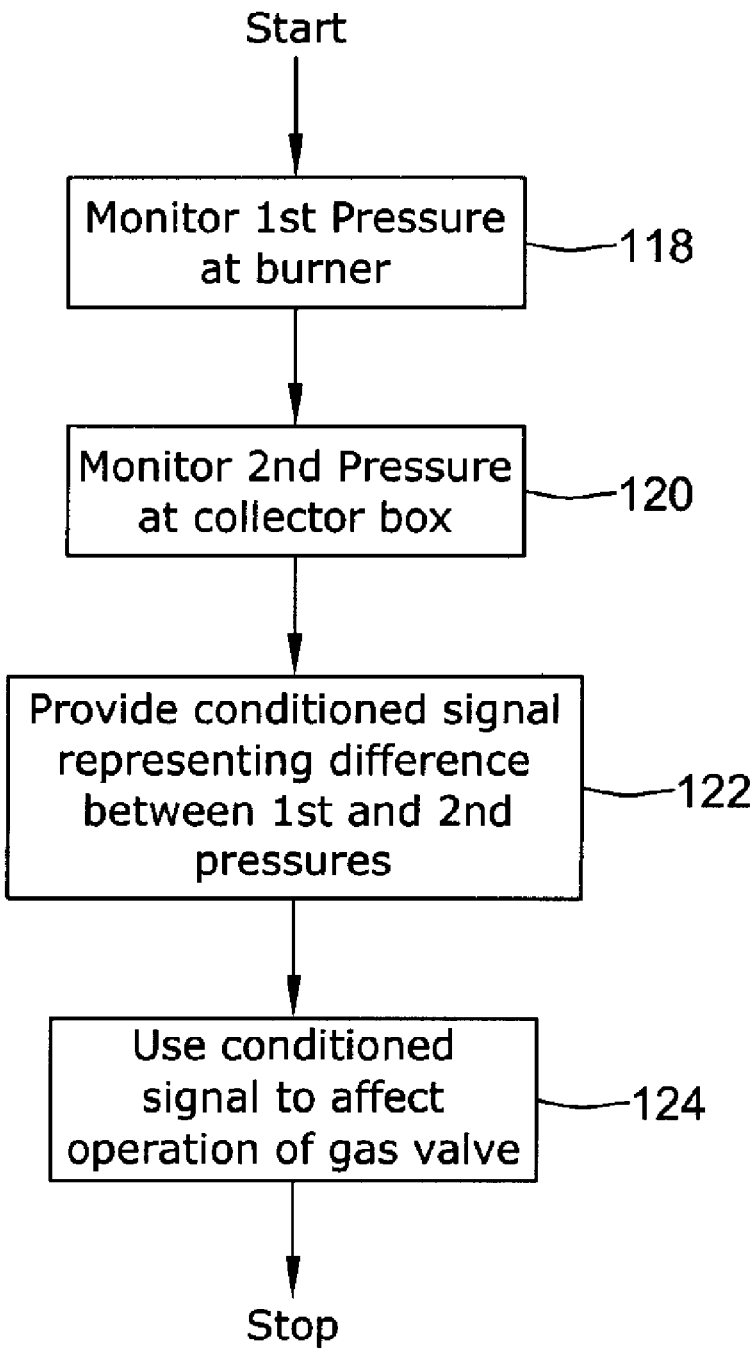
FIG. 11 is a flow diagram showing an illustrative but non-limiting method of operating the forced-air furnace of FIG. 1 in accordance with an embodiment of the invention.

FIG. 11 shows an illustrative but non-limiting method of operating the forced-air furnace of FIG. 1 in accordance with an embodiment of the invention. At block 118, a first pressure is monitored at the burner compartment 12 (FIG. 1). As discussed herein, this may represent a pressure at the entrance to heat exchanger 14 (FIG. 1). At block 120, a second pressure is monitored at the collector box 16 (FIG. 1). As discussed herein, this may represent a pressure at the exit from heat exchanger 14.

Control passes to block 122, wherein a conditioned signal is provided that represents a difference between the first and second pressures. The conditioned signal may, for example, be a pneumatic signal that is provided as a pressure difference between first outlet 32 and second outlet 36 of signal conditioner 28 (FIG. 1). This signal may be transmitted to first pressure port 42 (FIG. 1) and second pressure port 44 (FIG. 1) of gas valve 18 (FIG. 1). At block 124, the conditioned signal is used to affect the operation of gas valve 18.

The invention should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

What is claimed is:

1. A pneumatic signal conditioning device configured to provide a conditioned pressure signal representing a pressure drop across a heat exchanger, the pneumatic signal conditioning device comprising:

a first fluid path comprising a first inlet and a first outlet, the first fluid path configured such that the first outlet provides a first conditioned signal representing a burner box pressure at the first inlet;

a second fluid path comprising a second inlet and a second outlet, the second fluid path configured such that the second outlet provides a second conditioned signal representing a collector box pressure at the second inlet;

a third fluid path disposed between the first fluid path and the second fluid path, thereby providing fluid communication between the first fluid path and the second fluid path; and wherein a difference between the first conditioned signal and the second conditioned signal represents the pressure drop across the heat exchanger.

2. The pneumatic signal conditioning device of claim 1, wherein the first fluid path comprises an internal flow restriction.

3. The pneumatic signal conditioning device of claim 1, wherein at least one of the first inlet and the first outlet comprise a conditioning orifice.

4. The pneumatic signal conditioning device of claim 3, wherein the first inlet comprises a first inlet conditioning orifice and the first outlet comprises a first outlet conditioning orifice.

5. The pneumatic signal conditioning device of claim 1, wherein the second fluid path comprises an internal flow restriction.

6. The pneumatic signal conditioning device of claim 1, wherein at least one of the second inlet and the second outlet comprise a conditioning orifice.

7. The pneumatic signal conditioning device of claim 6, wherein the second inlet comprises a second inlet conditioning orifice and the second outlet comprises a second outlet conditioning orifice.

8. The pneumatic signal conditioning device of claim 1, further comprising a bleed orifice disposed within the third fluid path.

9. The pneumatic signal conditioning device of claim 1, further comprising a fourth fluid path disposed between the first fluid path and the second fluid path, thereby providing fluid communication between the first fluid path and the second fluid path.

10. The pneumatic signal conditioning device of claim 9, further comprising a fixed bleed orifice disposed within the third fluid path.

11. The pneumatic signal conditioning device of claim 10, further comprising an adjustable bleed orifice disposed within the fourth fluid path.

12. A forced-air furnace comprising:

a heat exchanger having an upstream port and a downstream port;

a burner configured to burn fuel and provide combustion products to the heat exchanger;

a gas valve configured to provide fuel to the burner, the gas valve comprising a first pressure port and a second pressure port; and a pneumatic signal conditioning device comprising:

a first fluid path comprising a first inlet and a first outlet, the first fluid path configured such that the first outlet provides a first conditioned signal representing a pressure at the first inlet; and a second fluid path comprising a second inlet and a second outlet, the second fluid path configured such that the second outlet provides a second conditioned signal representing a pressure at the second inlet;

wherein the first inlet is in fluid communication with the upstream port, the second inlet is in fluid communication with the downstream port, the first outlet is in fluid communication with the first pressure port and the second outlet is in fluid communication with the second pressure port such that a difference between the first outlet and the second outlet provides to the gas valve a conditioned pressure signal representing a pressure drop across the heat exchanger.

13. The forced-air furnace of claim 12, wherein the upstream port is proximate the burner.

14. The forced-air furnace of claim 12, further comprising a collector box positioned proximate the downstream port.

15. A negative pressure conditioning device for use with a forced air furnace having a gas valve, a burner manifold and a collector box, the negative pressure conditioning device comprising:

a first gas valve port adapted to be in fluid communication with the gas valve, a first conditioning orifice contained within the first gas valve port;

a second gas valve port adapted to be in fluid communication with the gas valve, a second conditioning orifice contained within the second gas valve port;

a burner manifold port adapted to be in fluid communication with the burner manifold, a burner manifold conditioning orifice contained within the burner manifold port; and a collector box port adapted to be in fluid communication with the collector box, a collector box conditioning orifice contained within the collector box port.

16. A pneumatic signal conditioning device configured to provide a conditioned pressure signal representing a pressure drop across a heat exchanger, the pneumatic signal conditioning device comprising:

a first fluid path comprising a first inlet and a first outlet, the first fluid path configured such that the first outlet provides a first conditioned signal representing a burner box pressure at the first inlet;

a second fluid path comprising a second inlet and a second outlet, the second fluid path configured such that the second outlet provides a second conditioned signal representing a collector box pressure at the second inlet;

a reference vent in fluid communication with at least one of the first fluid path and the second fluid path; and wherein a difference between the first conditioned signal and the second conditioned signal represents the pressure drop across the heat exchanger.

17. The pneumatic signal conditioning device of claim 16, wherein the reference vent is also in fluid communication with an atmosphere exterior to the pneumatic signal conditioning device.

* * * * *

UNITED STATES PATENT AND TRADEMARK OFFICE

CERTIFICATE OF CORRECTION

PATENT NO. : 7,644,712 B2
APPLICATION NO. : 11/164083
DATED : January 12, 2010
INVENTOR(S) : Michael W. Schultz It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 744 days.

Signed and Sealed this

Sixteenth Day of November, 2010

David J. Kappos

David J. Kappos
*Director of the United States Patent and Trademark Office*